US006550639B2

(12) United States Patent
Brown et al.

(10) Patent No.: US 6,550,639 B2
(45) Date of Patent: Apr. 22, 2003

(54) TRIBOELECTRIC SYSTEM

(75) Inventors: Colin W. Brown, Egham (GB); Robert D. Iverson, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 309 days.

(21) Appl. No.: 09/729,936

(22) Filed: Dec. 5, 2000

(65) Prior Publication Data

US 2002/0100494 A1 Aug. 1, 2002

(51) Int. Cl.[7] ..... A24F 27/14
(52) U.S. Cl. ..... 221/135; 15/1.52
(58) Field of Search ..... 221/135, 33, 45, 221/63, 303; 206/554, 494, 812; 15/1.51, 1.52, 208

(56) References Cited

U.S. PATENT DOCUMENTS

| | | | | |
|---|---|---|---|---|
| 1,804,364 | A | 5/1931 | Parker | |
| 1,886,235 | A | 11/1932 | Meissner | |
| 1,957,591 | A | 5/1934 | Heckert | 15/105 |
| 2,024,705 | A | 12/1935 | Rutherford | 179/106 |
| 2,284,039 | A | 5/1942 | Bruno | 179/111 |
| 2,460,109 | A | 1/1949 | Southworth | 179/171.5 |
| 2,618,803 | A | 11/1952 | Parmet | 15/209 |
| 2,724,457 | A | 11/1955 | Besser | 183/69 |
| 2,740,184 | A | 4/1956 | Thomas | 28/78 |
| 2,986,524 | A | 5/1961 | Padgett | 252/63.2 |
| 3,118,022 | A | 1/1964 | Sessler et al. | 179/111 |
| 3,144,671 | A | 8/1964 | Gould et al. | 15/1.5 |
| 3,193,912 | A | 7/1965 | Polin | 29/155.5 |
| 3,240,212 | A | 3/1966 | Royster | 131/9 |
| 3,301,786 | A | 1/1967 | Klass | 252/63.2 |
| 3,307,332 | A | 3/1967 | Grace et al. | 55/103 |
| 3,316,620 | A | 5/1967 | Stewart, Jr. | 29/155.5 |
| 3,325,003 | A | 6/1967 | Bilezerian | 206/57 |
| 3,354,373 | A | 11/1967 | Fatovic | 320/1 |
| 3,449,094 | A | 6/1969 | Baxt et al. | 29/195 |
| 3,458,713 | A | 7/1969 | Perlman et al. | 307/88 |

(List continued on next page.)

FOREIGN PATENT DOCUMENTS

| | | |
|---|---|---|
| EP | 0 721 760 A1 | 7/1996 |
| EP | 0 865 755 A1 | 9/1998 |
| EP | 0 872 206 A1 | 10/1998 |
| GB | 292479 | 6/1929 |
| GB | 2 069 327 A | 8/1981 |
| JP | 63-48981 | 10/1988 |
| JP | 5-25763 | 2/1993 |
| JP | 10262883 A | 10/1998 |

OTHER PUBLICATIONS

Author unknown, *Early History of Electrets*, 1 page, (Undated).

Bhatnagar et al., *Electrical Conductivity of Carnauba Wax Using Different Electrodes*, pp. 20–24, (1954).

(List continued on next page.)

*Primary Examiner*—Kenneth W. Noland

(57) ABSTRACT

Methods and systems for inducing an electric charge in a cleaning sheet for cleaning and removing particles from a surface are disclosed. The systems include a cleaning sheet for collecting and retaining the particles and a charging surface configured to frictionally engage the sheet. The cleaning sheets typically have a basis weight of at least about 30 g/m$^2$. The system may include a container for housing and dispensing the cleaning sheet. When the sheet is passed across the charging surface, the electrical charge in the sheet is generally increased by at least about 500 V. Methods of and kits for cleaning surfaces and collecting and retaining debris are also disclosed.

32 Claims, 7 Drawing Sheets

U.S. PATENT DOCUMENTS

| | | | | |
|---|---|---|---|---|
| 3,463,168 | A | 8/1969 | Troll et al. | 131/262 |
| 3,485,708 | A | 12/1969 | Ballou et al. | 161/72 |
| 3,487,610 | A | 1/1970 | Brown et al. | 55/130 |
| 3,494,821 | A | 2/1970 | Evans | 161/169 |
| 3,496,013 | A | 2/1970 | Baxt et al. | 117/227 |
| 3,496,461 | A | 2/1970 | Sessler et al. | 324/62 |
| 3,571,679 | A | 3/1971 | Turnhout | 317/262 |
| 3,612,778 | A | 10/1971 | Murphy | 179/111 |
| 3,616,157 | A | 10/1971 | Smith | 161/124 |
| 3,632,443 | A | 1/1972 | Kodera et al. | 117/227 |
| 3,644,605 | A | 2/1972 | Sessler et al. | 264/22 |
| 3,965,518 | A | 6/1976 | Muoio | 15/104.93 |
| 3,965,519 | A | 6/1976 | Hermann | 15/104.93 |
| 3,968,790 | A | 7/1976 | Fukada et al. | 128/82.1 |
| 4,095,303 | A | 6/1978 | Armstrong et al. | 15/1.5 R |
| 4,144,370 | A | 3/1979 | Boulton | 428/233 |
| 4,172,172 | A | 10/1979 | Suzuki et al. | 428/224 |
| 4,232,128 | A | 11/1980 | Michel et al. | 521/134 |
| 4,276,338 | A | 6/1981 | Ludwa et al. | 428/137 |
| 4,333,021 | A | 6/1982 | Cresap et al. | 307/87 |
| 4,352,846 | A | 10/1982 | Pässler et al. | 428/105 |
| 4,355,021 | A | 10/1982 | Mahl et al. | 424/28 |
| 4,373,224 | A | 2/1983 | Bandai et al. | 15/1.5 |
| 4,457,456 | A | 7/1984 | Derby et al. | 403/811 |
| 4,486,365 | A | 12/1984 | Kliemann et al. | 264/24 |
| 4,603,069 | A | 7/1986 | Haq et al. | 428/76 |
| 4,612,237 | A | 9/1986 | Frankenburg | 428/219 |
| 4,683,001 | A | 7/1987 | Floyd et al. | 106/3 |
| 4,845,512 | A | 7/1989 | Arway | 346/1.1 |
| 4,874,659 | A | 10/1989 | Ando et al. | 428/221 |
| 4,906,513 | A | 3/1990 | Kebbell et al. | 428/198 |
| 4,993,099 | A | 2/1991 | Emura et al. | 15/118 |
| 5,057,710 | A | 10/1991 | Nishiura et al. | 307/400 |
| 5,300,248 | A | 4/1994 | Pässler et al. | 252/90 |
| 5,310,590 | A | 5/1994 | Tochacek et al. | 428/102 |
| 5,325,992 | A | 7/1994 | Koller et al. | 221/63 |
| 5,429,848 | A | 7/1995 | Ando et al. | 428/36.2 |
| 5,486,411 | A | 1/1996 | Hassenboehler, Jr. et al. | 428/286 |
| 5,525,397 | A | 6/1996 | Shizuno et al. | 428/138 |
| 5,599,550 | A | 2/1997 | Kohlruss et al. | 424/404 |
| 5,671,498 | A | 9/1997 | Martin et al. | 15/244.3 |
| 5,706,804 | A | 1/1998 | Baumann et al. | 128/206.19 |
| 5,725,927 | A | 3/1998 | Zilg et al. | 428/89 |
| 5,726,107 | A | 3/1998 | Dahringer et al. | 442/414 |
| 5,817,584 | A | 10/1998 | Singer et al. | 442/345 |
| 5,830,810 | A | 11/1998 | Cohen | 442/110 |
| 5,834,384 | A | 11/1998 | Cohen et al. | 442/382 |
| 5,871,845 | A | 2/1999 | Dahringer et al. | 428/378 |
| 5,895,504 | A | 4/1999 | Sramek et al. | 8/137 |
| 5,940,054 | A | 8/1999 | Harris | 345/85 |
| 6,054,071 | A | 4/2000 | Mikkelsen, Jr. | 264/1.36 |

OTHER PUBLICATIONS

Gemant, *Phil. Mag. S. 7., 20*, Recent Investigations on Electrets, pp. 929–951, (1935).

Gross, *State of the Art Review, 6*, "Electret Devices For Air Pollution Control", pp. 1–10, (1972).

Gross, pp. 115–119 (Undated).

Gutmann, *Reviews of Modern Physics, 20*, "The Electret", pp. 457–472, (1948).

Scotch Brite™ Lens Cleaning Cloth Label, 1 sheet, (On sale at least by Jun. 1, 2000).

Technostat, *Air Filter Media, Filtration & Separation*, pp. 197–202 (4 color sheets), bearing a designation of Mar. 1996.

Technostat, *Cabin Air Filtration*, 4 color sheets (undated).

Letcher, *Kirk–Other Concise Encyclopedia Of Chemical Technology, 24*, "Waxes", pp. 1259–1260, (©1985).

Luminex™ Ultrafine Cleaning Cloth, 2 sheets, (Undated).

Swedish Microfiber Trasan® Cleaning Cloth, Internet web page, titled "How Trasan® Cloths and Mops clean using only water", available at http://www.trasan.com/microfiber.html, pp. 1–4, bearing a designation of May 22, 1997.

'Toray', Internet web page, titled "Toraysee* @ Ultra Fine Micro–Fiber Cleaning Cloth", available at http://www.toray.co.jp/e/jigyou/shohin/shohin_3.html, 1 sheet, bearing a designation "Last Updated Nov. 17, 1997".

"Toraysee" Luminex™ Ultrafine Microfiber Cleaning Cloth, 6 sheets, (Undated).

Trasan® Cloths and Mops, Internet web page, titled "Trasan® Cloths", available at http://www.trasan.com/products.html, pp. 1–3, bearing a designation of Jun. 27, 1997.

Trasan® Swedish Miracle Microfiber Cleaning Cloths and Mops, Internet web page, titled "Trasan®, Inc. 'Your Environmentally Friendly Cleaning Companions'® Main Page", available at http://www.trasan.com/index.html, bearing a designation of Jun. 13, 1997.

AllerCare Allergy Asthma Prevention, "Cleaning", http://www.allercare.com.sg/products/clean.asp, bearing a designation of "Oct. 16, 2000" (sheet).

Plug–In Storage Systems Inc., "Save the Boards", http://www.pluginstorage.com/html/save_the_boards_html, bearing a designation of Nov. 17, 2000 (9 sheets).

The ESD Association, "Basics of Electrostatic Discharge Part One—An Introduction to ESD," http://www.borg.com/~eosesd/cebasics.html, bearing a designation of "© 1996, 1997, 1998" (8 sheets).

Science Made Simple, "What is Static Electricity?," http://www.sciencemadesimple.com/static.html, bearing a designation of "© 1996, 2000"(8 sheets).

TRIBOELECTRIC SYSTEM

BACKGROUND

Dust cloths for removing dust from a surface to be cleaned (e.g., a table) are generally known. Such known dust cloths are typically made of woven or non-woven fabrics and are often sprayed or coated with a wet, oily substance for retaining the dust. However, such dust cloths can leave an oily film on the surface being cleaned.

Other known dust cloths include non-woven entangled fibers having spaces between the entangled fibers for retaining the dust. The entangled fibers are typically supported by a network grid or scrim structure, which can provide additional strength to such cloths. However, such cloths can become saturated with the dust during use (i.e., dust buildup) and/or may not be completely effective at picking up dense particles, large particles or other debris.

Facial tissues for removing bodily fluids (e.g., mucus) and debris (e.g., makeup) from a user are also generally known. Such facial tissues may include a moisturizer, oil or antibacterial agent to soothe the skin of the user. Such facial tissues typically are made of loose weave pulp fibers (e.g., entangled by an "air laid" process), and have a relatively low basis weight. Such facial tissues are typically drawn from a storage container, such as a flexible package or a rigid "tissue box." However, a problem with such facial tissues is that they are easily torn or broken, and do not effectively retain or attract common household debris particles such as dirt. Further, such facial tissues typically will not hold an electric charge for a period longer than a few seconds, due in part to their composition (typically paper pulp).

Accordingly, it would be advantageous to provide a cleaning sheet that can pick up and retain dust and debris. It would also be advantageous to provide a cleaning sheet that has an enhanced dust collection capacity. It would also be advantageous to provide a cleaning sheet that attracts debris without the use of a significant amount of an oily additive. It would also be advantageous to provide a cleaning sheet that retains relatively large and/or denser particles of debris. It would also be advantageous to provide a cleaning sheet that is relatively strong. It would further be advantageous to provide a cleaning sheet having any one or more of these or other advantageous features.

SUMMARY

The present application relates generally to cleaning sheets, such as for use in cleaning surfaces (e.g., in the home or work environment). In particular, the application relates to a cleaning sheet for collecting and retaining dust, larger particles and/or other debris. More particularly, the present application relates to a cleaning sheet capable of having an electric charge induced by triboelectric effects. The cleaning sheet may be useful for cleaning and removing particles and other debris from a surface such as a table, floor, article of furniture or the like. Some embodiments of the cleaning sheet may include multiple layers to increase debris retention and/or strength. The sheet typically has a basis weight of at least about 30 g/m$^2$.

In one embodiment, a system for cleaning and removing particles from a surface is provided. The system includes a cleaning sheet for collecting and retaining the particles, and may have a basis weight greater than about 30 g/m$^2$. The system also typically includes a container for housing and dispensing the cleaning sheet. The container includes a charging surface configured to frictionally engage the cleaning sheet. When the cleaning sheet is passed across the charging surface, the electrostatic charge in the cleaning sheet may be increased by at least about 500 V and more desirably by at least about 1000 V.

The container may include an interior receptacle configured for housing a plurality of cleaning sheets. The container also generally includes an outlet for dispensing at least one of the cleaning sheets. The outlet includes at least one and more commonly two charging surfaces. The first charging surface and the second charging surface may each be configured to frictionally engage a cleaning sheet as it is dispensed through the outlet, thereby inducing an electrical charge in the cleaning sheet.

According to another embodiment, a method of cleaning a surface is provided. The method includes dispensing the cleaning sheet from a generally nonconductive container. The container may include at least one charging surface. The frictional engagement of the cleaning sheet against the first charging surface may increase an electrostatic charge of the cleaning sheet by at least about 500 V. The method also includes contacting the surface with the cleaning sheet.

According to another embodiment, a kit for cleaning surfaces and collecting and retaining debris is provided. The kit includes a cleaning head and a cleaning sheet adapted for coupling to the head. The kit also includes a container for housing and dispensing the cleaning sheet. The container has at least one charging surface configured to frictionally engage the cleaning sheet as it is dispensed from the container. This type of container allows a charge of at least about 1000 V to be frictionally induced in the cleaning sheet. The cleaning sheet is then contacted with the surface to be cleaned before the electrostatic charge has been substantially dissipated.

The cleaning sheet typically has a relatively low overall breaking strength in order to preserve a relative amount of flexibility. The term "breaking strength" as used in this disclosure means the value of a load (i.e., the first peak value during the measurement of the tensile strength) at which the cleaning sheet begins to break when a tensile load is applied to the cleaning sheet. The breaking strength of the sheet should be high enough to prevent "shedding" of fibers or tearing of the cleaning sheet during use. The breaking strength of the cleaning sheet is typically at least about 500 g/30 cm, and cleaning sheets with breaking strengths of 1,500 g/30 cm to 4,000 g/30 cm are quite suitable for use with the cleaning implements.

When intended to be used with a cleaning utensil, mounting structure, or the like, the cleaning sheet typically has a relatively low overall elongation to assist in resisting "bunching" or "puckering" of the cleaning sheet. The term "elongation" as used in this disclosure means the elongation percentage (%) of the cleaning sheet when a tensile load of 500 g/30 mm is applied. For example, when designed to be used in conjunction with a mop or similar cleaning implement where the cleaning sheet is fixedly mounted, the present cleaning sheets typically may have an elongation of no more than about 25% and, preferably, no more than about 15%.

The terms "surface" and "surface to be cleaned" as used in this disclosure are broad terms and are not intended as terms of limitation. The term surface as used in this disclosure includes substantially hard or rigid surfaces (e.g., plastic, wood, articles of furniture, tables, shelving, floors, ceilings, hard furnishings, household appliances, glass, and the like), as well as relatively softer or semi-rigid surfaces (e.g., rugs, carpets, fabrics soft furnishings, linens, clothing, flesh and the like).

The term "debris" as used in this disclosure is a broad term and is not intended as a term of limitation. In addition to dust and other fine particulate matter, the term debris includes relatively large-sized particulate material (e.g., having an average diameter greater than about 1 mm) such as large-sized dirt, food particles, crumbs, soil, sand, lint, and waste pieces of fibers and hair, which may not be collected with conventional dust rags, as well as dust and other fine particulate matter.

Throughout this disclosure, the text refers to various embodiments of the cleaning sheet and/or methods of using the sheet. The various embodiments discussed are merely illustrative and are not meant to limit the scope of the present invention. The various embodiments described are intended to provide a variety of illustrative examples and should not necessarily be construed as descriptions of alternative species since the descriptions of the various embodiments may be of overlapping scope.

DETAILED DESCRIPTION

Figure 1:
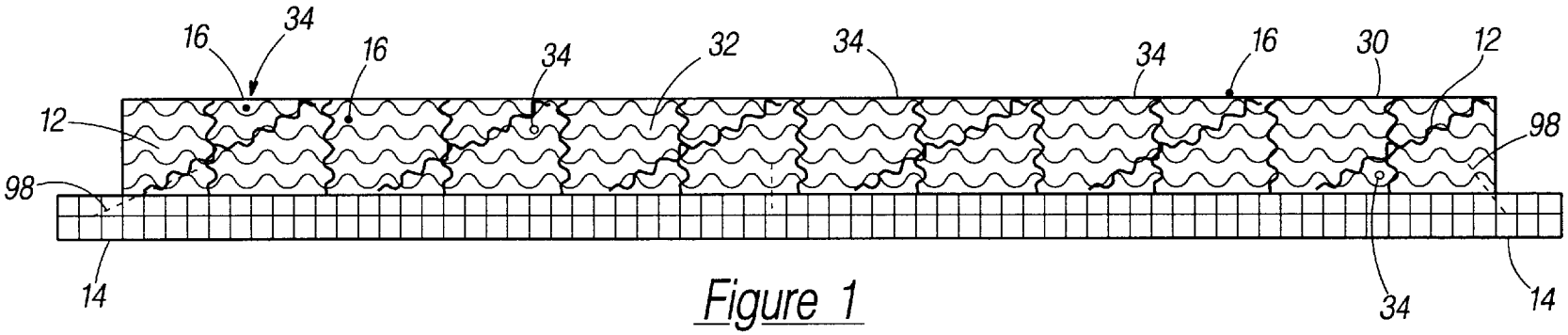
FIG. 1 is a sectional view of a cleaning sheet according to an exemplary embodiment.

Referring to FIG. 1, one example of a dusting pad (shown as a cleaning sheet 10 made of multiple fibers 12) for collecting, attracting and retaining particulate matter (e.g., dust, soil, other airborne matter, lint, hair, etc. and shown as debris 16) is shown. Cleaning sheet 10 may include a particle retention surface 30, which may be increased in charge with an electrostatic force for attracting (e.g., collecting) and retaining debris 16. When so charged, debris 16 is drawn and/or forced to the particle retention surface 30 as cleaning sheet 10 is moved along a surface to be cleaned (shown as a worksurface 78 in FIG. 13).

Cleaning sheet 10 may be provided with structural elements intended to increase strength. For example, particle retention surface 30 may be supported by a web or lattice (shown as a scrim 64 in FIG. 12 supporting fibers 12). Cleaning sheet 10 can include an optional internal core 32, which may be located adjacent any side of surface 30 or core 32, made of an entangled network of fibers 12 (e.g., non-woven, microfibers, etc.) within cleaning sheet 10. An optional backing layer 14 may be attached to particle retention surface 30 by a fastener (e.g., physical bond, construction adhesives, clips, embossment, hydroentanglement, ultrasonic weld, infrared weld, spot weld, chemical bond, melt bond of thermoplastic melt in localized locations, etc. and shown as a stitch 98).

The term "non-woven" as used in this disclosure includes a web having a structure of individual fibers or threads which are interlaid, but not necessarily in a regular or identifiable manner as in a knitted fabric. The term also includes individual filaments and strands, yarns or "tows" as well as foams and films that have been fibrillated, apertured, or otherwise treated to impart fabric-like properties. Non-woven fabrics or webs have been formed from many processes such as for example, meltblowing processes, spunbonding processes, and bonded carded web processes. The basis weight of non-woven fabrics is usually expressed in ounces of material per square yard ("osy") or grams per square meter ("gsm") and the fiber diameters useful are usually expressed in microns. Basis weights can be converted from osy to gsm simply by multiplying the value in osy by 33.91. According to another suitable embodiment, the fibers may be woven.

Particle retention surface 30 and core 32 can trap, collect, attract and retain a significant amount of particulate matter. Typically, the cleaning sheet is configured to retain at least about 20 $g/m^2$ of particulate matter, suitably at least about 1–10 $g/m^2$, more suitably at least about 1–5 $g/m^2$. A pore or cavity 34 for retaining debris 16 can be formed between fibers 12 in core 32 or in particle retention surface 30. The cavities typically have an average width in the range of about 1 to 10 mm, more suitably 2 to 5 mm, depending in part on the size of the particulate matter intended to be retained, and can have an average depth in the range of about 0.1 to 5 mm, more suitably 1 to 3 mm. The cleaning sheet may have the capacity to retain debris having a relatively small size. The debris typically has an effective diameter of about 5–10 microns. The electrostatic charge of the cleaning sheet may affect the size and density of the particle intended to be collected. Increasing the electrostatic charge can enhance the efficacy of the sheet in entrapping and retaining particles.

The particle retention layer and the core may include a dielectric or conducting material that may be rendered "electret" in whole or in part. The rendering electret of the material in a cleaning sheet may thereby cause an electrostatic charge to build-up on the cleaning sheet. Such build-up of an electrostatic charge may enhance the ability of the cleaning sheet to attract, collect, trap and retain debris during the cleaning process.

The cleaning sheet, or any part thereof, may be rendered electret by "triboelectric charging" techniques. Triboelectric charging is the "electrostatic charge" (commonly referred to as "static electricity") that may be created by friction. In general, static electricity is an electrical charge caused by an imbalance of electrons on the surface material of an object. The imbalance of electrons produces an electric field that can electrically influence other objects. Static charges on generally non-conductive surface materials (e.g., polystyrene foam, rubber, plastic, etc.) are generally localized across the surface of the object. Charges on generally conductive surface materials (e.g., ungrounded metal, human skin, etc.) are generally evenly distributed across the surface of the object.

Figure 2:
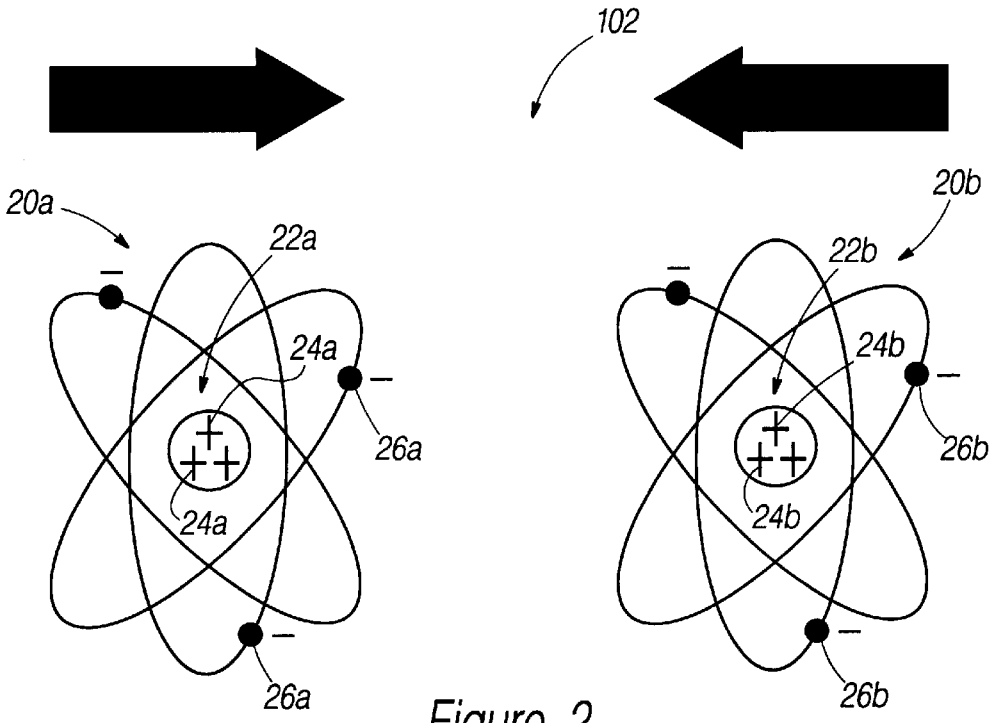
FIG. 2 is a schematic diagram of atoms being brought into physical contact.

Triboelectric charging includes the contact and separation of two similar or dissimilar materials (e.g., a cleaning sheet and a charging surface), which transfers electrons between the materials. For example, an electrostatic charge is generated on an electrostatic field when a shoe sole contacts and then separates from a wood floor surface, and the charge from the electrostatic field is passed by induction to a conductive moisture layer on the foot of the shoe wearer. For example, electrons may be transferred from the foot to the wood floor surface, thereby decreasing the number of electrons in the foot and correspondingly increasing the positive charge of the foot. Referring to FIG. 2, one material (e.g., a foot) is shown having an atom 20*a* with three protons 24*a* (relatively tightly bound in a nucleus 22*a*) and three orbiting electrons 26*a*, and another material (e.g., a wood floor) is shown having an atom 20*b* with three of protons 24*b* in a nucleus 22*b* and three orbiting electrons 26*b*. (An atom with more electrons than protons (i.e., an "anion") will have a negative charge, and an atom with more protons than electrons (i.e., a "cation") will have a positive charge.) In FIG. 2, both atom 20*a* and atom 20*b* each have a net electrical charge of zero, since the three negatively charged electrons cancel the charge of the three positively charged protons. Atom 20*a* and atom 20*b* may be brought into contact (e.g., rubbing, agitating, sliding, etc.) with one another (step 102).

Figure 3:
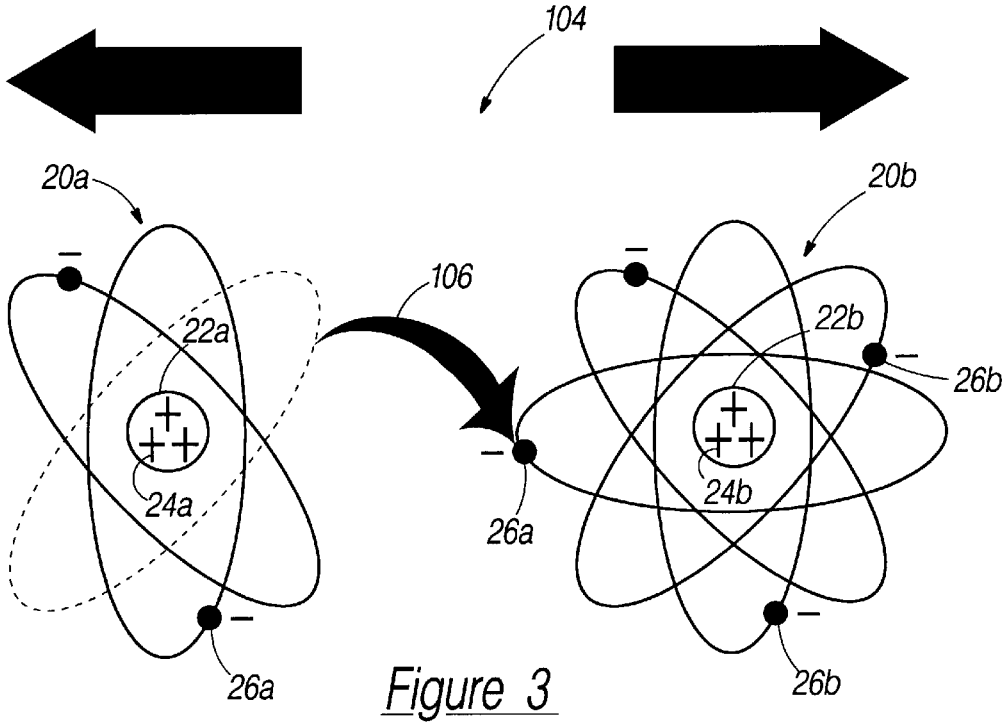
FIG. 3 is a schematic diagram of the atoms of FIG. 2 separated from physical contact

When atom 20*a* is placed in contact with atom 20*b* (step 102) and then separated from atom 20*b* (see FIG. 3 step 104), an electron 26*a* is transferred (step 106) from atom 20*a* to atom 20*b* (i.e., atom 20*a* loses electron 26*a* and atom 20*b* gains electron 26*a*). Thus atom 20*a* obtains a positive charge (i.e., having three positively charged protons and two negatively electrons) and atom 20*b* obtains a negative charge (i.e., having three positively charged protons and four negatively charged electrons).

The determination of which materials generally lose electrons and which materials generally gain electrons depends in part on the nature of the materials and their ability to retain or donate electrons. The determination may be predicted by the ranking of materials in the triboelectric series shown in Table 1. Under ideal conditions, if two materials are contacted together and separated, the material listed in Table 1 shown as "most positive" should donate electrons and become positively charged, and the material shown as "most negative" should gain electrons and become negatively charged. Other materials that may be categorized as "most negative" relative to human hands include: acetate fiber, epoxy glass, stainless steel, synthetic rubber, acrylic, polystyrene foam, polyurethane foam, and polyester, respectively. Household debris such as dust, hair and clothing fibers can have either a positive or a negative charge. According to a suitable embodiment, the cleaning sheet has a negative charge and/or is induced with a negative triboelectric charge.

TABLE 1

| | |
|---|---|
| Air | Most Positive |
| Human Hands | |
| Asbestos | ↑ |
| Rabbit Fur | |
| Glass | |
| Mica | |
| Human Hair | |
| Nylon | |
| Wool | |
| Fur | ZERO |
| Lead | |
| Silk | |
| Aluminum | |
| Paper | |
| Cotton | |
| Steel | |
| Wood | |
| Amber | |
| Sealing Wax | |
| Hard Rubber | |
| Mylar | |
| Nickel, Copper | |
| Brass, Silver | ↓ |
| Gold, Platinum | |
| Sulfur | Most Negative |
| Acetate, Rayon | |
| Celluloid | |
| Polyester | |
| Styrene (Styrofoam) | |
| Orlon ® yarn[1] | |
| Saran ™ | |
| Polyurethane | |
| Polyethylene | |
| Polypropylene | |
| Vinyl (PVC) | |
| Kel F ® materials[2] | |
| Silicon | |
| Teflon ® materials[3] | |
| Silicone Rubber | |

The triboelectric charge induced in the cleaning sheet may be retained indefinitely, depending in part on the material used, atmospheric conditions (e.g., humidity, temperature, pressure, etc.), handling, etc. For example, in some materials such as facial tissue the triboelectric charge could decay in about a few seconds (depending on atmospheric conditions). In other materials such as a polypropylene scrim, the triboelectric charge could decay in about thirty minutes (depending on atmospheric conditions). The magnitude of charge created by triboelectric charging may be affected in part by factors such as the area of contact of the materials, nature of contact, the speed of separation of the materials, relative humidity of the environment, etc. Examples of the amount of charge created by triboelectric charging are shown in Table 2. As illustrated in Table 2, higher charges tend to be generated under conditions of low relative humidity (e.g., about 10%) than under moderate relative humidity (e.g., about 40–50%). Triboelectrically charged materials also tend to maintain an electrostatic charge longer under low relative humidity than under conditions of moderate to high relative humidity.

TABLE 2

| | Change in Charge (Volts) at Specified Relative Humidity | | |
|---|---|---|---|
| Triboelectric Charging Source | 10% | 40% | 55% |
| Walk across carpet | 35,000 | 15,000 | 7,500 |
| Walk across vinyl tile | 12,000 | 5,000 | 3,000 |
| Work at seating surface | 6,000 | 500 | 400 |

TABLE 2-continued

| Triboelectric Charging Source | Change in Charge (Volts) at Specified Relative Humidity | | |
|---|---|---|---|
| | 10% | 40% | 55% |
| Vinyl envelopes for work instructions | 7,000 | 1,500 | 750 |
| Common poly bag picked up from worksurface | 20,000 | 6,500 | 3,000 |
| Work at chair padded with polyurethane foam | 18,000 | 5,000 | 3,000 |
| Remove circuit boards from standard bubble wrap | 26,000 | 20,000 | 7,000 |
| Package circuit boards in standard foam-lined box | 21,000 | 11,000 | 550 |

Figure 4:
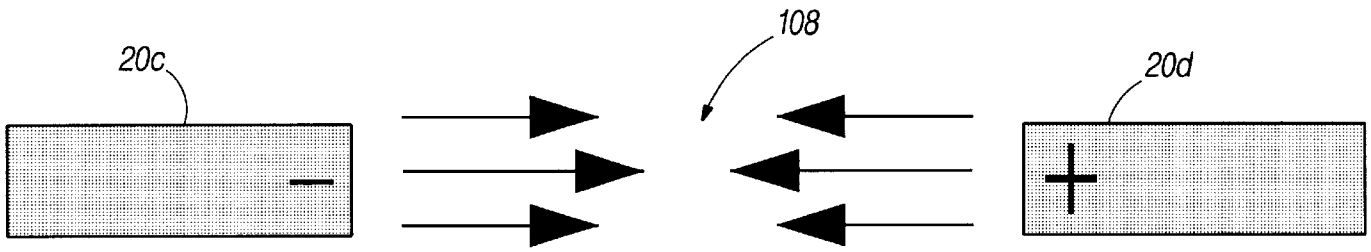
FIG. 4 is a schematic diagram of atoms having opposite charges being attracted.
Figure 5:
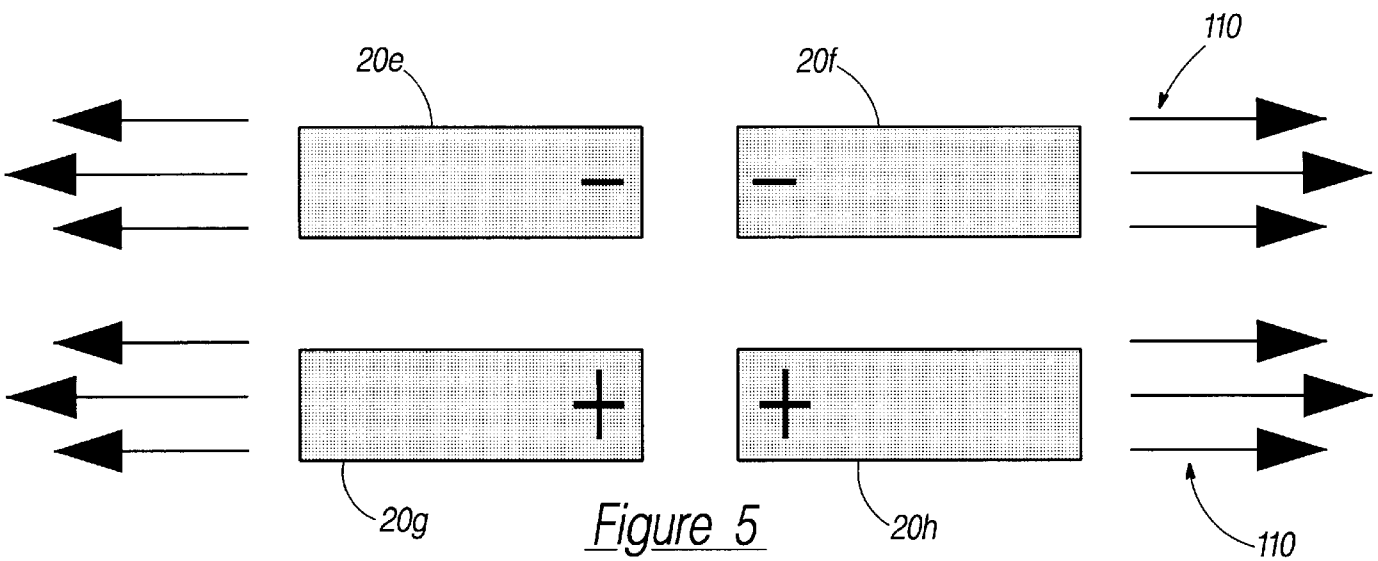
FIG. 5 is a schematic diagram of atoms having similar charges being repelled.

The cleaning sheet that is induced with a triboelectric charge may transfer at least a portion of the induced charge to another material (e.g., debris) during an electrostatic discharge or ESD event (i.e., the transfer of charge between bodies at different electrical potentials). Referring to FIG. 4, the cleaning sheet or material that is induced with a negative triboelectric charge (shown as an atom 20*c*) is shown attracting or pulling a material having a positive charge (shown as a debris particle or atom 20*d*) (step 108). This is commonly known as the phenomena that "opposite charges attract." Likewise, opposite or differently charged particles repel or push away particles having an opposite or different charges. (See step 110 of FIG. 5 showing the repulsion of debris particles or atoms 20*e* and 20*f* each having a negative charge, and the repulsion of debris particles or atoms 20*g* and 20*h* each having a positive charge.)

Without intending to be limited to any particular theory, it is believed that the strength of the electrostatic attraction or repulsion between particles having opposite charges is determined by Coulombs Law, which states:

$$F = \frac{k(q1 \cdot q2)}{d^2}$$

where "F" is the force of the attraction or repulsion, "q" is the charge, "d" is the distance between the charges and "k" is the proportionality constant, which depends on the material separating the charges. The strength of the attraction or repulsion between particles having opposite charges may depend on the amount of charge, the distance involved, the shape of the particles, etc.

Figure 6:
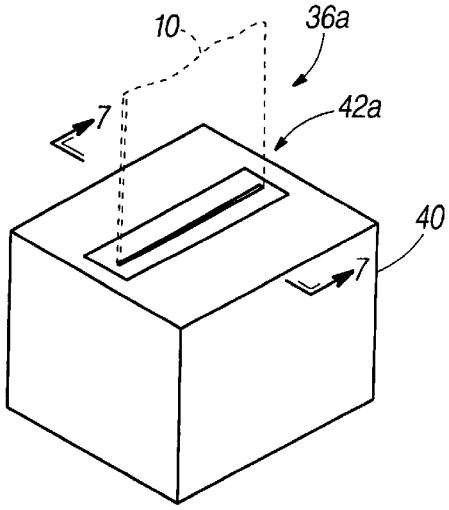
FIG. 6 is a perspective view of a dispensing mechanism according to an exemplary embodiment.
Figure 7:
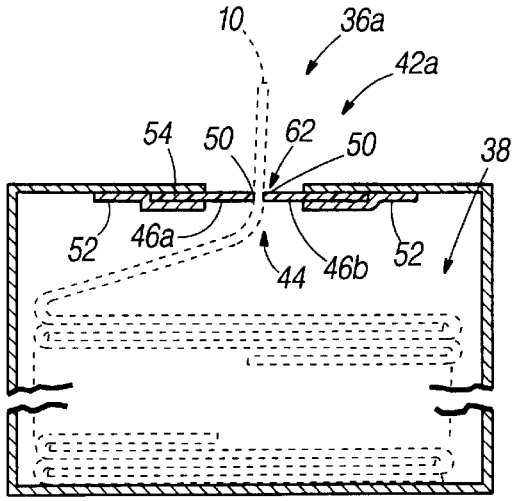
FIG. 7 is a fragmentary cross-sectional view of the dispensing mechanism of FIG. 6 along line 7—7 of FIG. 6.

Referring to FIG. 6, a triboelectric charging device or dispensing mechanism (shown as a dispenser 36*a*) for storing multiple cleaning sheets 10 in an interior reservoir or receptacle (shown as a cavity 38) of a container 40 is shown. Dispenser 36*a* may impart or increase the temporary triboelectric electrostatic charge on cleaning sheet 10 by pulling sheet 10 through an outlet 42*a* of dispenser 36*a*. Referring to FIG. 7, cleaning sheet 10 is shown partially drawn through outlet 42*a*. Outlet 42*a* includes a charger 44 having a first charging platform or horizontal shelf (shown as a plate 46*a*) generally coplanar with a second charging platform or flange (shown as a plate 46*b*), which may abut or mate to form a dispensing aperture (shown as a slit 62 ). Both sides of cleaning sheet 10 may contact base charging surface 50 of plates 46*a* and 46*b* as sheet 10 is dragged across plates 46*a* and 46*b*. Plates 46*a* and 46*b* may have a sufficiently different value on the triboelectric scale (see Table 1) than the value of cleaning sheet 10 on the triboelectric scale. The resulting friction (e.g., contact and separation) of cleaning sheet 10 against plates 46*a* and 46*b* causes an accumulation of electrostatic charge on sheet 10.

Plate 46*a* and plate 46*b* are shown attached to container 40 by a mounting structure shown as a bracket 52. Plate 46*a* and plate 46*b* are shown inserted into a cavity 54 of bracket 52, which substantially counteracts the upward force applied to plates 46*a* and 46*b* as cleaning sheet 10 is slid upwardly through outlet 42*a*. According to alternative embodiments, any fastener may be used to attach the charging plates to the container (e.g., glue, stitching, clip, lamination, integral formation, etc.).

Figure 10:
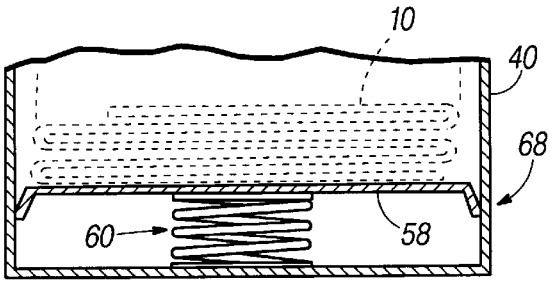
FIG. 10 is a fragmentary sectional view of an actuator according to a suitable embodiment.

Referring to FIG. 10, an actuator 68 is shown for lifting unused or stored cleaning sheets 10 within cavity 38 of container 40 toward the outlet. Actuator 68 includes a raised floor or base plate 58 for supporting stored cleaning sheets 10. Base plate 58 is shown supported by an extension mechanism (shown as a compression spring 60) that is selectively movable between a retracted or lowered position (e.g., when container 40 is full) and an extended or raised position (e.g., when container 40 is less than full). As spring 60 is extended, base plate 58 is raised and stored cleaning sheets 10 are moved toward the outlet for quick and easy removal. According to an alternative embodiment as shown in FIG. 7, stored cleaning sheets 10 can be interlocked by folding, such that the removal of one sheet places the underlying sheet in position for removal through the outlet of container 40 (e.g., the removal of one sheet presents the beginning of the second sheet through the outlet). According to other alternative embodiments, the cleaning sheet may be a continuous sheet, which may be cut (or torn at predetermined, pre-cut perforations) at any desired length after withdrawal from the container.

Figure 8:
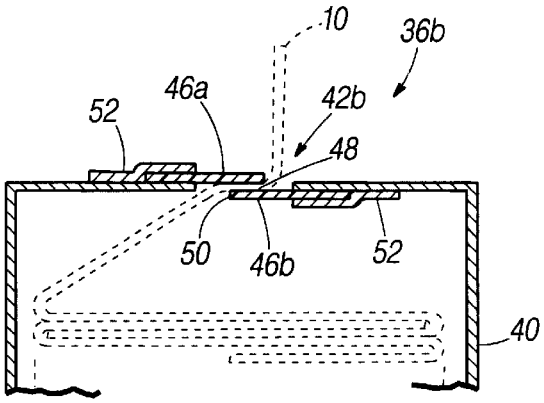
FIG. 8 is a fragmentary sectional view of a dispensing mechanism according to a preferred embodiment.

Referring to FIG. 8, a dispenser 36*b* is shown according to an alternative embodiment. The structure of an outlet 42*a* of dispenser 36*a* differs from outlet 42*b* of dispenser 36*b*. Other than this difference, the construction, performance and function of dispenser 36*b* is substantially the same as dispenser 36*a*, and like reference numerals are used to identify like elements. Charging plate 46*a* is shown positioned above and slightly overlapping charging plate 46*b*, and plates 46*a* and 46*b* are generally parallel. An auxiliary wall or charging surface 48 of plates 46*a* and 46*b* contacts cleaning sheet 10 as sheet 10 is withdrawn from dispenser 36*b*. In addition, both sides of cleaning sheet 10 may contact charging surface 50 as sheet 10 is withdrawn from dispenser 36*b*. Without intending to be limited to any particular theory, it is believed that dispenser 36*b* is generally capable of imparting a greater triboelectric charge on the cleaning sheet 10 than dispenser 36*a*, due in part to the increased charging surface areas of charging plates 46*a* and 46*b* (relative to charging surface 50), which contact sheet 10 during its removal from the container.

Figure 9:
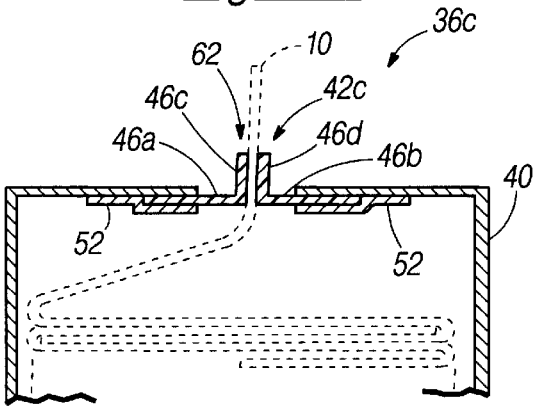
FIG. 9 is a fragmentary sectional view of a dispensing mechanism according to an alternative embodiment.

Referring to FIG. 9, a dispenser 36*c* is shown according to an alternative embodiment. The structure of an outlet 42*c* of dispenser 36*c* differs from outlet 42*a* of dispenser 36*a*. Other than this difference, the construction, performance and function of dispenser 36*c* is substantially the same as dispenser 36*a*, and like reference numerals are used to identify like elements. Charging plate 46*a* is shown generally coplanar with a charging plate 46*b* to form slot or slit 62, similar to plates 46*a* and 46*b* shown in FIG. 7. A vertically depending leg (relative to the base of dispenser 36*c*) shown as a charging plate 46*c* and a charging plate 46*d* extends upwardly from each of plates 46*a* and 46*b*, respectively. Plates 46*c* and 46*d* form a "chimney", ridge or chute, which increases the surface area over which cleaning sheet 10 is in contact (compared to dispenser 36*a* shown in FIG. 7).

Figure 11:
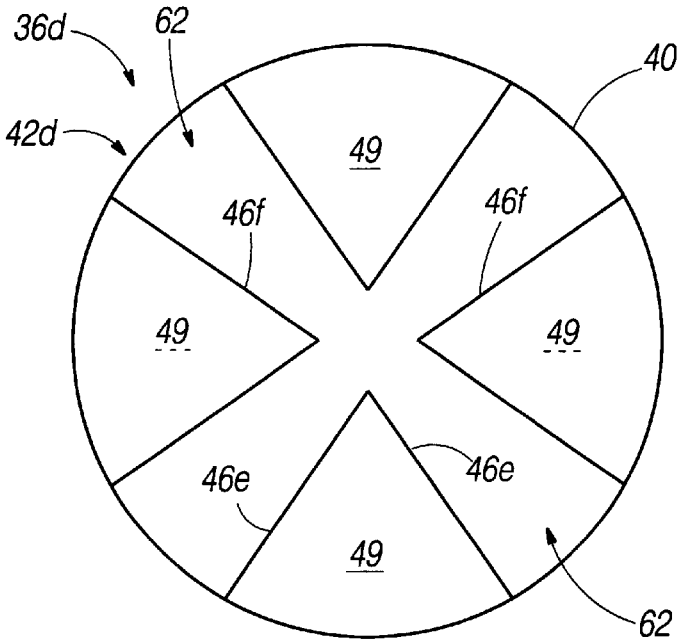
FIG. 11 is a top plan view of an outlet of a dispensing mechanism according to an alternative embodiment.

Referring to FIG. 11, a dispenser 36*d* is shown according to an alternative embodiment. The structure of an outlet 42*d* of dispenser 36*d* differs somewhat from outlet 42*a* of dispenser 36*a*. Other than this difference, the construction, performance and function of dispenser 36*d* is substantially the same as dispenser 36*a*, and like reference numerals are used to identify like elements. Container 40 is shown having a generally circular or "tube" shape. Multiple protrusions, fingers or tabs (shown as charging plates 46*e* and 46*f*) are shown partially encircling slit 62. Charging plates 46*e* are "tiered," stepped, or leveled above charging plates 49 (similar to overlapping charging plates 46*a* and 46*b* shown in FIG. 8). The elevated charging plates 46*e* provide an increased charging surface 49, which may frictionally engage sheet 10 as it is drawn through slot 62.

The charging plates could be made of any material appearing above or below the material on the triboelectric scale (see Table 1) from which the cleaning sheet is composed. According to a suitable embodiment, the charging plates are made of a material to impart a negative charge on the cleaning sheet. Suitably, the charging plates are made from polyvinyl chloride ("PVC") or TEFLON materials (commercially available from E.I. Du Pont De Nemours and Company of Wilmington, Del.). According to a suitable embodiment, the charging plate is a rigid sheet or surface. According to other alternative embodiments, the charging plate is a flexible sheet that is held relatively taut, such that there is sufficient friction between the cleaning sheet and the charging plate during dispensing of the cleaning sheet. The container may be made from an insulator through which electrons do not move well according to a suitable embodiment. Suitable insulators could include plastic, cloth, glass and dry air, plastics, rubber and wood. According to an alternative embodiment, the container may be made from a conductor or a semi-conductor. The container may be made of a rigid material such as cardboard according to a suitable embodiment, or may be made of a semi-rigid material such as a plastic or a relatively thin film according to other alternative embodiments.

The cleaning sheet may include a non-woven fabric formed from fibers or micro-fibers. The fibers used in the cleaning sheet are typically formed from thermoplastic materials. Thermoplastic materials are believed to retain an electrostatic charge for relatively long periods. Thermoplastic materials or fibers may include, without limitation, polyesters, polyamides and polyolefins, polypropylene, polyethylene, polystyrene, polycarbonate, nylon, rayon, acrylic, etc. and combinations thereof. The thermoplastic materials may be produced by a melt blown process. According to a suitable embodiment, the cleaning sheet can be a spinbond or thermal bond polypropylene.

The fibers may also include synthetic materials such as polyolefins (such as, polypropylene and polybutene), polyesters (such as polyethylene, polyurethane terephthalate and polybutylene terephthalate), polyamides (such as nylon 6 and nylon 66), acrylonitriles, vinyl polymers and vinylidene polymers (such as polyvinyl chloride and polyvinylidene chloride), and modified polymers, alloys, and semi-synthetic materials such as acetate and polytetrafluoroethylene (PTE) fibers. The fibers may also include natural materials such as rubber, latex, cotton, blends of cotton, wool, cellulose and the like. The fibers may also include regenerated or recyclable fibers such as Cupra, rayon and acrylics. The fibers may also include combinations of synthetic materials, semi-synthetic materials, natural materials, regenerated or recyclable materials, and combinations thereof. The core can be made of a porous sponge or foam. Suitable foams include polyurethane foams and latex foams. Other suitable foams include phenolic resin foams. According to other suitable embodiments, the cleaning sheet and fibers may be made of other materials that have a relatively high dust retention capacity.

The cleaning sheet may be made of a fabric material (e.g., a continuous sheet as shown in FIG. 9) according to an exemplary embodiment. According to a suitable embodiment, the fabric may be non-woven. Non-woven fabrics may be made by mechanically (such as by hydroentanglement), chemically or thermally interlocking layers or networks of fibers (or filaments or yarns). Non-woven fabrics may be made by interlocking fibers or filaments concurrent with their extrusion and/or by perforating relatively thin films. According to alternative embodiments, the fabric material may be woven, such as those traditional textile fabrics made by weaving (i.e., the interlacing of two or more yam sets at right angles on a loom), or by knitting (i.e., the interlooping of one or more yarns upon itself or themselves).

The fibers may be rendered electret by any variety of methods. According to a preferred embodiment, the fibers may be rendered electret by using triboelectric effects, as described in the following Examples 1 through 6. According to alternative embodiments, the fibers can be rendered electret by coating them with an electret material such as a wax. The fibers may also be rendered electret by spinning them in a strong electrostatic field. The fibers may also be rendered electret by passing them by a charged electrode. According to a suitable embodiment, at least 20% of the fibers are rendered electret (by weight percentage), and in some instances as much as 50–100% of the fiber materials may be electret.

The rendering electret of the cleaning sheets may induce or impart a total or increased electrostatic charge greater than about 500 V, suitably more than about 800–900 V, more suitably more than about 1200–1500 V, most suitably between about 2000–4000 V. The fibers may have a charge suitably in the range of about $1\times10^{-11}$ to $1\times10^{-11}$ coulombs/cm$^2$, more suitably about $1\times10^{-5}$ to $1\times10^{-3}$ coulombs/cm$^2$.

At least a portion of the particle retention surface, core and/or scrim of the cleaning sheet may be indirectly rendered electret by application of an electret wax (i.e., a material that has been rendered relatively permanently electrically charged) according to alternative embodiments. Cleaning sheets having applied wax electrets are described in co-pending U.S. patent application Ser. No. 09/605,021 titled "Particle Entrapment System" filed on Jun. 29, 2000, the disclosure of which is hereby incorporated by reference.

The fibers (e.g., woven and non-woven) of the cleaning sheet may be directly rendered electret directly (e.g., without the application of an electret wax) according to other alternative embodiments. Such cleaning sheets having fibrous electrets are described in co-pending U.S. patent application Ser. No. 09/605,021 titled "Particle Entrapment System" filed on Jun. 29, 2000.

According to alternative embodiments, the cleaning sheet may also be rendered electret by ferroelectric effects, wherein a ferroelectric material exhibits oppositely polarized charge on its two surfaces because of applied pressure. According to other suitable embodiments, the cleaning sheet may be rendered electret by applying light (instead of a charge) at room temperature (e.g., illumination with 6000 lux of light). According to still other suitable embodiments, certain photoelectric insulating or semi-conducting materials of the cleaning sheet may be rendered electret under the combined influence of illumination and a strong electric field.

Figure 12:
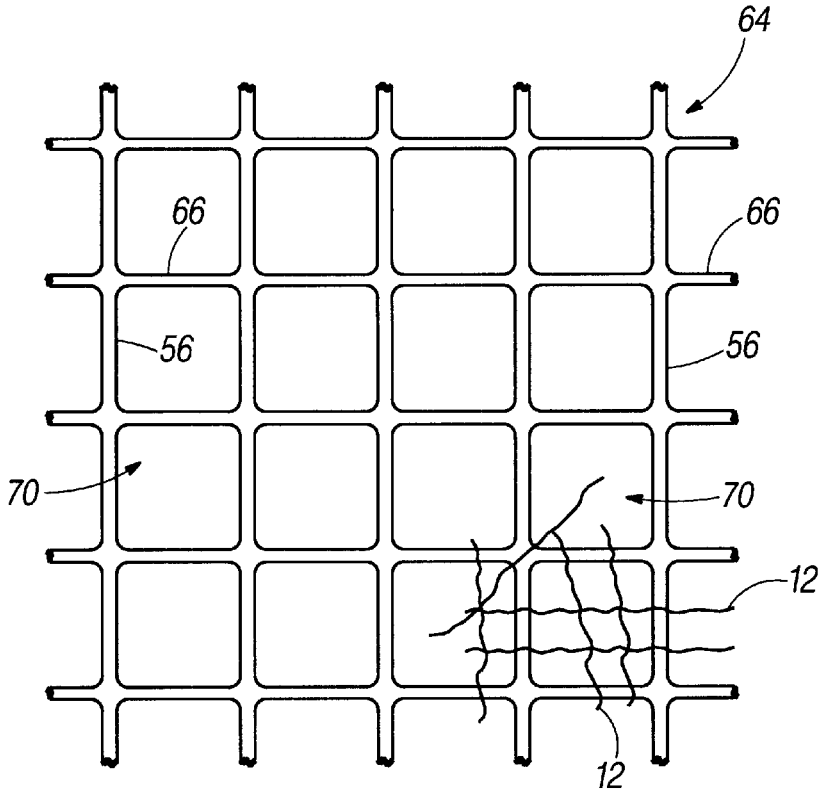
FIG. 12 is a top plan view of a web according to a suitable embodiment.

Referring to FIG. 12, a web or lattice (shown scrim 64) may support fibers 12 of cleaning sheet 10. Use of the web can allow the production of sheets that have a relatively low entanglement coefficient (e.g., no more than about 800 m) while retaining sufficient strength to be used for cleaning. Scrim 64 may include a net having horizontal members 66 attached to vertical members 56 arranged in a "network" configuration. Spaces (shown as holes 70) are formed between vertical members 56 and horizontal members 66 to give scrim 64 a mesh or lattice-like structure. According to various embodiments, the horizontal and vertical members of the scrim may be connected together in a variety of ways such as woven, spot welded, cinched, tied, etc. The average diameter of holes 70 generally falls within the range of 20 to 500 mm, and more suitably between 100 to 200 mm. The distance between the fibers typically falls within about 2 to 30 mm, and more suitably within about 4 to 20 mm. Alternatively, the non-woven sheet may be reinforced by filaments embedded in the sheet which are held in place simply by the mechanical forces resulting from hydroentangling or "air punching" microfibers around the filaments.

Fibers 12 of cleaning sheet 10 may be overlaid on each side of scrim 64 to attach fibers 12 to scrim 64, thereby forming cleaning sheet 10 as a unitary piece or structure. A low-pressure water jet may be subsequently applied to entangle the fibers to each other and to scrim 64 (i.e., hydroentanglement) to form a relatively lose entanglement of non-woven fibers. Hydroentanglement of the fibers may be further increased during removal (e.g., drying) of the water from the water jet. (The scrim may also "shrink" somewhat during drying to create a fabric having a "puckered" or contoured surface.) The fibers may also be attached to the web (i.e., scrim) by a variety of other conventional methods (e.g., air laid, adhesive, woven, etc.). The fibers are typically entangled onto the web to form a unitary body, which assists in preventing "shedding" or loss of the fibers from the web during cleaning. The web may be formed from a variety of suitable materials, such as polypropylene, nylon, polyester, etc. An exemplary web (i.e., scrim) is described in U.S. Pat. No. 5,525,397, the disclosure of which is hereby incorporated by reference.

The core (e.g., core 32 as shown in FIG. 1) may include a non-woven aggregate layer having fibers with a relatively large degree freedom and sufficient strength, which may be advantageous for effectively collecting and retaining dust and larger particulates within the cleaning sheet. In general, a non-woven fabric formed by the entanglement of fibers involves a higher degree of freedom of the constituent fibers than in a non-woven fabric formed only by fusion or adhesion of fibers. The non-woven fabric formed by the entanglement of fibers can exhibit better dust collecting performance through the entanglement between dust and the fibers of the non-woven fabric. The degree of the entanglement of the fibers can have a relatively large effect on the retention of dust. That is, if the entanglement becomes too strong, the freedom of fibers to move will be lower and the retention of dust will be generally decreased. In contrast, if the entanglement of the fibers is relatively weak, the strength of the non-woven fabric can be markedly lower, and the processability of the non-woven fabric may be problematic due to its lack of strength. Also, shedding of fibers from the non-woven fabric is more likely to occur from a non-woven aggregate with a relatively low degree of entanglement.

The backing layer (e.g., backing layer 16 shown in FIG. 1) may be more rigid and/or have a greater basis weight than the core and/or particle retention surface to provide support and structure to the cleaning sheet. According to suitable embodiments, a space or other intermediate layer(s) may be positioned between the backing layer and the outer fabric layer. A variety of materials are suitable for use as a backing layer, as this layer has the desired degree of flexibility and is capable of providing sufficient support to the sheet as a whole. Examples of suitable materials for use as a backing layer include a wide variety of relatively lightweight (e.g., having a basis weight of about 10 to 75 g/m$^2$), flexible materials capable of providing the sheet with sufficient strength to resist tearing or stretching during use. The backing layer is typically relatively thin (e.g., has a thickness of about 0.05 mm to about 0.5 mm) and can be relatively non-porous. Examples of suitable materials include spunbond and thermal bond non-woven sheets formed from synthetic and/or natural polymers. Other backing materials that can be utilized to produce the cleaning sheet include relatively non-porous, flexible layers formed from polyester, polyamide, polyolefin or mixtures thereof. The backing layer could also be made of hydroentangled non-woven fibers, if it meets the performance criteria necessary for the particular application. One specific example of a suitable backing layer is a spunbond polypropylene sheet with a basis weight of about 20 to 50 g/m$^2$.

The degree of entanglement of the fibers in the sheet can be measured by an "entanglement coefficient." The entanglement coefficient is also referred to as the "CD initial modulus." The term "entanglement coefficient" as used in this disclosure refers to the initial gradient of the stress-strain curve measured with respect to the direction perpendicular to the fiber orientation in the fiber aggregate (cross machine direction). The term "stress" as used in this disclosure means a value which is obtained by dividing the tensile load value by the chucking width (i.e., the width of the test strip during the measurement of the tensile strength) and the basis weight of the non-woven fiber aggregate. The term "strain" as used in this disclosure is a measure of the elongation of the cleaning sheet material.

A relatively small value of the entanglement coefficient generally represents a smaller degree of entanglement of the fibers. The entanglement coefficient may be controlled in part by selection of the type and quantity of fibers, the weight of the fibers, the amount and pressure of the water, etc. (See U.S. Pat. No. 5,525,397 at col. 4, line 52—col. 5, line 26 discussing entanglement of fibers.) If the entanglement coefficient is relatively small (e.g., no more than about 10 to 20 m), the fibers will not be sufficiently entangled together. In addition, the entanglement between the fibers and the scrim will likely be poor as well. As a result, shedding of the fibers may occur frequently. If the entanglement coefficient is relatively large (e.g., greater than about 700 to 800 m), a sufficient degree of freedom of the fibers cannot be obtained due to strong entanglement. This can prevent the fibers from easily entangling with dust, hair and/or other debris, and the cleaning performance of the sheet may not be satisfactory.

Suitable non-woven fiber aggregates for use in forming the cleaning sheet may have an entanglement coefficient in the range of about 20 to 500 m (as measured after any reinforcing filaments or network has been removed from the non-woven fibrous web) and, more typically, no more than about 250 m. A suitable non-woven aggregate for use in producing the cleaning sheet can be formed by hydroentangling a fiber web (with or without embedded supporting filaments or a network sheet) under a relatively low pressure. For example, the fibers in a carded polyester non-woven web can be sufficiently entangled with a network sheet by processing the non-woven fiber webs with water jetted at high speed under about 25–50 kg/cm$^3$ of pressure. The water can be jetted from orifices positioned above the web as it passes over a substantially smooth non-porous supporting drum or belt. The orifices typically have a diameter ranging between 0.05 and 0.2 mm and can be suitably arranged in rows beneath a water supply pipe at intervals of 2 meters or less.

In cases where the entanglement coefficient of the fiber aggregate is to be set at a maximum value of about 800 m, it may be difficult for a sheet, which is constituted only of a fiber aggregate, to achieve the values of sufficient breaking strength and elongation. By entangling fibers 12 to scrim 64 (as shown in FIG. 12) into a unitary body, the elongation of this layer is kept low and its processability can be enhanced. Shedding of the fibers from the cleaning sheet can often be markedly prevented as compared with a conventional entangled sheet, which is constituted only of a fiber aggregate in approximately the same entanglement state as that in the fiber aggregate of the cleaning sheet.

The cleaning sheet typically includes a non-woven fiber aggregate (e.g., core) having a relatively low basis weight. The basis weight of the non-woven fiber aggregate generally falls within the range of about 30 to 100 g/m$^2$, and typically no more than about 75 g/m$^2$. If the basis weight of the non-woven fiber aggregate is less than about 30 g/m$^2$, dust may pass too easily through the non-woven fiber aggregate during the cleaning operation and its dust collecting capacity may be limited. If the basis weight of the non-woven fiber aggregate is too large (e.g., substantially greater than about 150 g/m$^2$), the fibers in the non-woven fiber aggregate (if any) generally may not be sufficiently entangled with each other to achieve a desirable degree of entanglement. In addition, the processability of the non-woven fiber aggregate can worsen, and shedding of the fibers from the cleaning sheet may occur more frequently.

The term "denier" as used in this disclosure is defined as the weight in grams of a 9000 meter length of fiber. The denier of the fibers of the particle retention surface is suitably about 0.1–6, more suitably about 0.5–3. The denier of the fibers in the non-woven fiber aggregate, the length, the cross-sectional shape and the strength of the fibers used in the non-woven fiber aggregate are generally determined in view of processability and cost, in addition to factors relating to performance.

Cleaning sheet 10 may be used alone (e.g., as a rag) or in combination with other implements and utensils to clean worksurface 78. Cleaning sheet 10 is generally flexible for following any contour (e.g., smooth, jagged, irregular, creviced, etc.) of a worksurface 78 to be cleaned. Accordingly, cleaning sheet 10 is particularly suitable for cleaning hard, rigid surfaces. According to another embodiment, cleaning sheet 10 may be semi-rigid and particularly suitable for cleaning planar surfaces. Cleaning sheet 10 may also be used to clean relatively soft surfaces such as carpets, rugs, upholstery and other soft articles.

Figure 13:
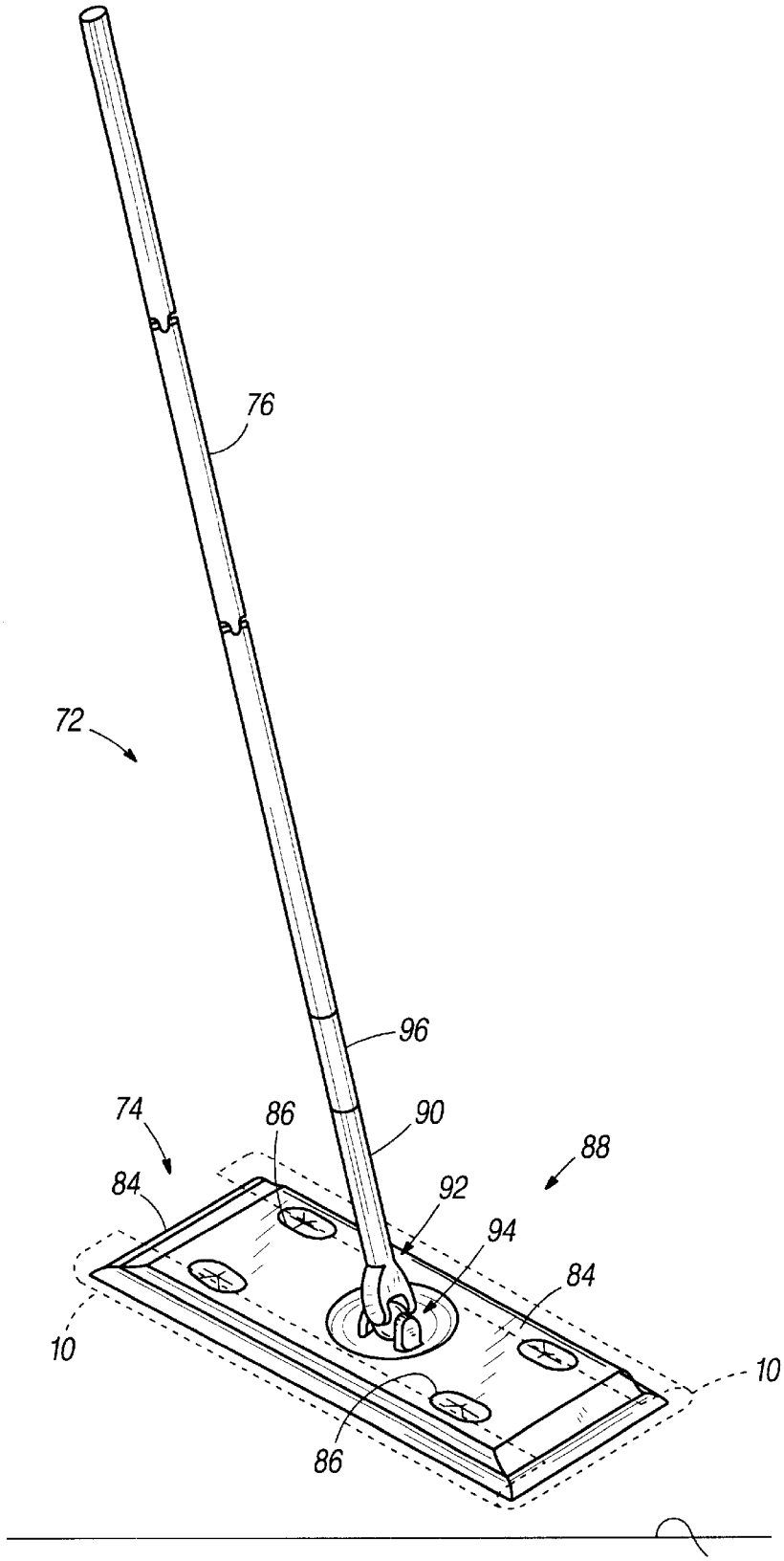
FIG. 13 is a perspective view of a cleaning utensil according to an exemplary embodiment.

Referring to FIG. 13, cleaning sheet 10 is shown attached to a cleaning head 74 of a cleaning utensil (shown as a dust mop 72) according to an exemplary embodiment. Head 74 includes a carriage 84 providing a fastener (shown as a spring clip 86) for mounting cleaning sheet 10. A mounting structure 88 attaches an elongate rigid member (shown as a segmented handle 76) to carriage 84. Mounting structure 88 includes a yoke (shown as an arm 90) having a y-shaped end 92 pivotally mounted to a socket (shown as a ball joint 94). An adapter (shown as a connector 96) threadably attaches arm 90 to handle 76. According to suitable embodiments, the cleaning utensil may be a broom, brush, polisher, handle or the like adapted to secure the cleaning sheet. The cleaning sheet may be attached to the cleaning utensil by any of a variety of fasteners (e.g., friction clips, screws, adhesives, retaining fingers, etc.). According to other suitable embodiments, the cleaning sheet may be attached as a single unit or as a plurality of sheets (e.g., strips, strings or "hairs" of a mop).

The components of the cleaning utensil, namely the mounting structure, adapter, handle, wax that may have been rendered electret, and the charging device may be provided individually or in combinations (e.g., as a kit or package). The components of the cleaning utensil may be readily, easily and quickly assembled and disassembled in the field (e.g., work site, home, office, etc.) or at the point of sale for compactability and quick replacement. The cleaning utensil may also be provided in a pre-assembled and/or unitary condition. According to a suitable embodiment, the cleaning sheet is configured for use with the PLEDGE GRAB-IT™ sweeper (commercially available from S.C. Johnson & Son, Incorporated of Racine, Wis.).

To clean worksurface 78, cleaning sheet 10 may be secured to head 74 of mop 72 by clip 86. Cleaning sheet 10 is brought into contact with worksurface 78 and moved along worksurface 78 (e.g., in a horizontal direction, vertical direction, rotating motion, linear motion, etc.). Debris 16 from worksurface 78 is provided or electrically attracted to particle retention surface 30. An electrostatic charge of particle retention surface 30 may pull or draw debris 16 to cleaning sheet 10 (see FIG. 4). After use, cleaning sheet 10 may be removed from mop 72 for disposal, cleaning (e.g., washing, shaking, removing debris, etc.), recycling, etc. According to other suitable embodiments, the cleaning sheet may be used alone (e.g., hand held) to clean the surface.

Cleaning implements and methods of cleaning surfaces using the cleaning sheet are also provided. The cleaning implement may be produced as an intact implement or in the form of a cleaning utensil kit. Intact implements may include gloves, dusters and rollers. Kits according to the present invention, which are designed to be used for cleaning surfaces, commonly include a cleaning head and a cleaning sheet capable of being coupled to the cleaning head. In addition, the kit can include a yoke capable of installation on the cleaning head and an elongate handle for attachment to the yoke. Whether provided as a completely assembled cleaning implement or as a kit, the cleaning implement may include a cleaning head that allows the cleaning sheet to be removably attached to the cleaning head.

A cleaning sheet sample may be tested for breaking strength (cross machine direction). From each of the cleaning sheets, samples having a width of 30 mm may be cut out in the direction perpendicular to the fiber orientation in the sheet (i.e., in the cross machine direction). The sample may be chucked with a chuck-to-chuck distance of 100 mm in a tensile testing machine and elongated at a rate of 300 mm/min in the direction perpendicular to the fiber orientation. The value of load at which the sheet began to break (the first peak value of the continuous curve obtained by the stress/strain measurement) may be taken as the breaking strength.

A cleaning sheet sample may be tested for elongation at a load of 500 g/30 mm. The breaking strength in the cross machine direction, as described above, may be measured. For the purposes of this test, "elongation" is defined as the relative increase in length (in %) of a 30 mm strip of cleaning sheet material when a tensile load of 500 g is applied to the strip.

A cleaning sheet sample may be tested for entanglement coefficient. The scrim may be removed from the non-woven fiber aggregate. Where the scrim has a lattice-like net structure, this is typically accomplished by cutting the fibers that make up the network sheet at their junctures and removing the fragments of the network sheet from the non-woven fiber aggregate with a tweezers. A sample having a width of 15 mm may be cut out in the direction perpendicular to the fiber orientation in the sheet (i.e., in the cross machine direction). The sample may be chucked with a chuck-to-chuck distance of 50 mm in a tensile testing machine, and elongated at a rate of 30 mm/min in the direction perpendicular to the fiber orientation (in the cross machine direction). The tensile load value F (in grams) with respect to the elongation of the sample may be measured. The value, which is obtained by dividing the tensile load value F by the sample width (in meters) and the basis weight of the non-woven fiber aggregate W (in g/m$^2$), is taken as the stress, S (in meters). A stress-strain curve is obtained by plotting stress ("S") against the elongation ("strain" in %) (i.e., stress S [m]=(F/0.015)/W).

Figure 14:
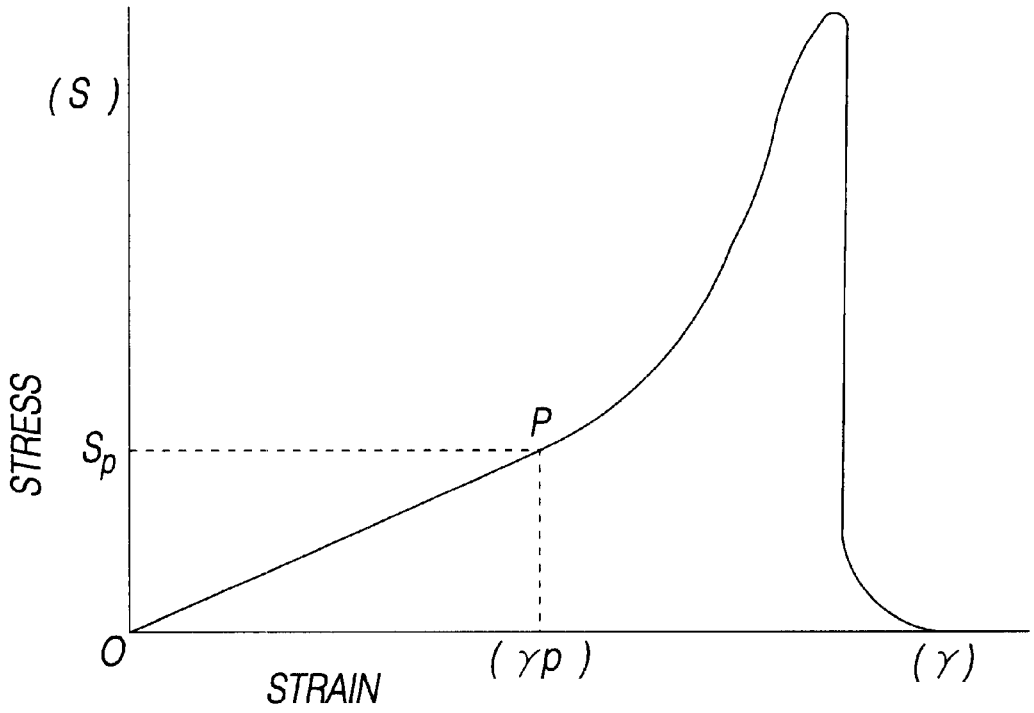
FIG. 14 is a graph showing a stress-strain curve where the vertical axis represents the stress, the horizontal axis represents the strain, and O represents the origin.

For a non-woven fiber aggregate, which is held together only through the entanglement of the fibers, a straight-line relationship is generally obtained at the initial stage of the stress-strain (elongation) curve. The gradient of the straight line is calculated as the entanglement coefficient E (in meters). For example, in the illustrative stress-strain curve shown in FIG. 14 (where the vertical axis represents the stress, the horizontal axis represents the strain, and O represents the origin), the limit of straight-line relationship is represented by P, the stress at P is represented by $S_p$, and the strain at P is represented by $\gamma_p$ as a percentage. In such cases, the entanglement coefficient is calculated as $E=S_p/\gamma_p$. For example, when $S_p$=60 m and $\gamma_p$=86%, E is calculated as E=60/0.86=70 m. It should be noted that the line OP is not always strictly straight. In such cases, a straight line approximates the line OP.

Varieties of sample cleaning sheets having differing material compositions were induced with a triboelectric charge using a triboelectric charging device. Some of the samples may retain at least a portion of the induced triboelectric charge for about one day. The test methodology and results are outlined in the following Examples.

EXAMPLE 1

The triboelectric charge induced in a sample of non-oiled PLEDGE GRAB-IT™ sweeper cloth (i.e., including a polyester with polypropylene reinforcement, and made by a hydroentanglement process) when drawn through a charging device was measured. The charging device included two generally co-planar charge transfer media (substantially as in FIGS. 6 and 7). The charge of the sample was measured using a model no. 344 electrostatic voltmeter having a range of 0 to +/−2000 V commercially available from Trek Inc. of Medina, N.Y.

The voltmeter was set to a "0" value. A piece of the sample was inserted through a dispensing mechanism of the charging device. About one inch of the sample was exposed outside of the dispensing mechanism, and the remaining sample was left inside of the dispensing mechanism. Before the sample was pulled through the dispensing mechanism, a first reading of a portion of sample inside the dispensing mechanism was taken at a distance of about 6 inch from the probe of the meter. The sample was then pulled through the mechanism at a relatively rapid rate. After the sample was pulled through the dispensing mechanism, a second reading of a portion of the sample outside the dispensing mechanism was taken at a distance of about 6 inch from the probe of the meter. The results of the test are shown in Table 3. In Tables 3 through 8, voltage readings are positive or negative; negative readings are indicated with a "−" symbol.

TABLE 3

| | Charge Before Mechanism (v) | Charge After Mechanism (v) | Charge Difference (v) |
|---|---|---|---|
| 1 | −157 | −1060 | −903 |
| 2 | −331 | −976 | −645 |
| 3 | −207 | −860 | −653 |
| 4 | −579 | −1751 | −1172 |
| 5 | −82 | −381 | −299 |
| 6 | −212 | −821 | −609 |
| 7 | −353 | −1030 | −677 |
| 8 | −277 | −707 | −430 |
| 9 | −245 | −849 | −604 |
| 10 | −163 | −861 | −698 |
| Ave: | −261 | −903 | −669 |

As shown for trial 1 in Table 3, the charge of the cleaning sheet after dispensing through the charging mechanism increased by about 250%.

EXAMPLE 2

The triboelectric charge induced in a sample of non-oiled PLEDGE GRAB-IT™ sweeper cloth (i.e., including a polyester with polypropylene reinforcement, and made by a hydroentanglement process) when drawn through a charging device was measured. The test methodology was substantially the same as the test methodology of Example 1, except that the charging device included two generally overlapping charge transfer media plates (substantially as shown in FIG. 8). The results of the test are shown in Table 4.

TABLE 4

| | Charge Before Mechanism (v) | Charge After Mechanism (v) | Charge Difference (v) |
|---|---|---|---|
| 1 | −412 | −1549 | −1137 |
| 2 | −345 | −1327 | −982 |
| 3 | −175 | −1256 | −1081 |
| 4 | −89 | −1596 | −1507 |
| 5 | −116 | −1096 | −980 |
| 6 | −365 | −1050 | −685 |
| 7 | −374 | −1698 | −1324 |
| 8 | −111 | −1079 | −968 |
| 9 | −197 | −1093 | −896 |
| 10 | −224 | −1218 | −994 |
| Ave: | −241 | −1296 | −1055.4 |

EXAMPLE 3

The electrostatic charge applied to a sample of PLEDGE GRAB-IT™ sweeper cloth commercially available from S.C. Johnson & Son, Incorporated of Racine, Wis. (i.e., 5% mineral oil by weight percent of total cloth weight, including a polyester with polypropylene reinforcement, and made by a hydroentanglement process) when drawn through a charging device was measured. The test methodology was substantially the same as the test methodology of Example 1. As in Example 1, the charging device included two generally co-planar charge transfer media (substantially as shown in FIGS. 6 and 7). The results of the test are shown in Table 5.

TABLE 5

| | Charge Before Mechanism (v) | Charge After Mechanism (v) | Charge Difference (v) |
|---|---|---|---|
| 1 | 6 | 6 | 0 |
| 2 | −9 | −1 | 8 |
| 3 | −5 | −3 | 2 |
| 4 | 0 | −4 | −4 |
| 5 | 1 | 2 | 1 |
| 6 | 0 | 1 | 1 |
| 7 | 0 | 0 | 0 |
| 8 | −3 | −2 | 1 |
| 9 | −4 | −8 | −4 |
| 10 | −4 | −11 | −7 |
| Ave: | −1.8 | −2 | −0.2 |

EXAMPLE 4

The absolute magnitude of the electrostatic charge applied to a sample of GRAB-IT™ sweeper cloth commercially available from S.C. Johnson & Son, Incorporated of Racine, Wis. (i.e., 5% mineral oil by weight percent of total cloth weight, including a polyester with polypropylene reinforcement, and made by a hydroentanglement process) when drawn through a charging device was measured. The test methodology was substantially the same as the test methodology of Example 1, except that the charging device included two generally overlapping charge transfer media plates ally as shown in FIG. 8). The results of the test are shown in Table 6.

TABLE 6

| | Charge Before Mechanism (v) | Charge After Mechanism (v) | Charge Difference (v) |
|---|---|---|---|
| 1 | 4 | 721 | 717 |
| 2 | 0 | 733 | 733 |
| 3 | 0 | 422 | 422 |
| 4 | 0 | 50 | 50 |
| 5 | 4 | 271 | 267 |
| 6 | 0 | 378 | 378 |
| 7 | −4 | 270 | 274 |
| 8 | 8 | 470 | 462 |
| 9 | −3 | 613 | 616 |
| 10 | −2 | 439 | 441 |
| Ave: | 1 | 437 | 436 |

EXAMPLE 5

A sample of non-oiled cloth (i.e., polyester/polypropylene blend, and made by a needlepunch process) was first run through an electric field (e.g., one side of the sample drawn past a positive electrode and the other side of the sample drawn past a negative electrode without either side substantially touching either of the electrodes). The sample was stored for about one year. The electrostatic charge applied was measured after the sample was then drawn through a charging device. The test methodology was substantially the same as the test methodology of Example 1. As in Example 1, the charging device included two generally co-planar charge transfer media (substantially as shown in FIG. 7). The results of the test are shown in Table 7.

TABLE 7

| | Charge Before Mechanism (v) | Charge After Mechanism (v) | Charge Difference (v) |
|---|---|---|---|
| 1 | 20 | 340 | 320 |
| 2 | 44 | 226 | 182 |
| 3 | 22 | 325 | 303 |
| 4 | 25 | 284 | 259 |
| 5 | 0 | 305 | 305 |
| 6 | −25 | 230 | 255 |
| 7 | −78 | 188 | 266 |
| 8 | 10 | 332 | 322 |
| 9 | 0 | 259 | 259 |
| 10 | −9 | 225 | 234 |
| Ave: | 1 | 271 | 270.5 |

EXAMPLE 6

A sample of non-oiled cloth (i.e., polyester/polypropylene blend, and made by a needlepunch process) was first run through an electric field (e.g., one side of the sample drawn past a positive electrode and the other side of the sample drawn past a negative electrode without side substantially touching either of the electrodes). The sample was stored for about one year. The electrostatic charge applied was measured after the sample was then drawn through a charging device. The test methodology was substantially the same as the test methodology of Example 1, except that the charging device included two generally overlapping charge transfer media plates (substantially as shown in FIG. 8). The results of the test are shown in Table 8.

TABLE 8

| | Charge Before Mechanism (v) | Charge After Mechanism (v) | Charge Difference (v) |
|---|---|---|---|
| 1 | −7 | 1611 | 1618 |
| 2 | 10 | 1864 | 1854 |
| 3 | 30 | 1189 | 1159 |
| 4 | −13 | 1932 | 1945 |
| 5 | −6 | 1837 | 1843 |
| 6 | 1 | 1199 | 1198 |
| 7 | −13 | 1276 | 1289 |
| 8 | −58 | 1838 | 1896 |
| 9 | 36 | 1084 | 1048 |
| 10 | 33 | 1959 | 1936 |
| Ave: | 1 | 1579 | 1577.6 |

Although only a few exemplary embodiments have been described, the present invention is not limited to one particular embodiment. Indeed, to practice the invention in a given context, those skilled in the art may conceive of variants to the embodiments described herein (e.g., variations in sizes, structures, shapes and proportions of the various elements, values of parameters, mounting arrangements, use of materials, etc.) without materially departing from the true spirit and scope of the invention. For example, the charging device can have an outlet having a variety of configurations such as a slit, a slot, and orifice, etc. according to alternative embodiments. Multiple charging plates can be oriented in a variety of locations along the outlet according to alternative embodiments. The cleaning sheet may be dragged across multiple charging plates according to alternative embodiments. Various modifications may be made to the details of the disclosure without departing from the spirit of the invention.

What is claimed is:

1. A system for cleaning and removing particles from a surface comprising:

a cleaning sheet for collecting and retaining the particles having a basis weight of at least about 30 g/m$^2$;

a container for housing and dispensing the cleaning sheet, the container comprising at least one charging surface configured to frictionally engage the cleaning sheet;

wherein the cleaning sheet has a charge that is increased by at least about 500 V when the cleaning sheet is passed across the charging surface.

2. The system of claim 1 wherein the cleaning sheet comprises no more than about 5 weight % oil.

3. The system of claim 2 wherein a charge of at least about 1500 V is induced in the sheet when the cleaning sheet is dispensed through an outlet.

4. The system of claim 2 wherein a charge of at least about $1.0\times10^{-11}$ C/cm$^2$ is imparted to the cleaning sheet when the cleaning sheet is passed across the charging surface.

5. The system of claim 2 wherein the cleaning sheet is capable of retaining a charge of at least about 1500 V for at least about 5 minutes at 10% relative humidity.

6. The system of claim 5 wherein the cleaning sheet is capable of retaining a charge of at least about 1500 V for at least about 1 hour at 10% relative humidity.

7. The system of claim 1 wherein the cleaning sheet has a breaking strength of at least about 500 g/30 cm.

8. The system of claim 1 wherein the charge in the cleaning sheet is increased by at least about 1000 V when the cleaning sheet is passed along the charging surface.

9. The system of claim 1 wherein the cleaning sheet has an elongation of no more than about 25% at a load of about 500 g/30 mm.

10. The system of claim 1 wherein the cleaning sheet is configured to attract particles having a size less than about 10 microns in diameter.

11. The system of claim 1 wherein the cleaning sheet has a particle retention capacity of at least about 20 g/m$^2$.

12. The system of claim 1 wherein the cleaning sheet comprises a plurality of fibers selected from the group comprising polyester fibers, polyamide fibers, polyolefin fibers, polystyrene fibers, polycarbonate fibers, rayon fibers, acrylic fibers, and combinations thereof.

13. The system of claim 12 wherein the cleaning sheet further comprises a reinforcing scrim structure.

14. The system of claim 12 wherein at least two of the plurality of fibers are coupled to each other by at least one of hydroentanglement or air punching.

15. The system of claim 1 wherein the cleaning sheet comprises an electret wax.

16. The system of claim 1 wherein the first charging surface is selected from the group comprising wood, amber, sealing wax, hard rubber, sulfur, acetate, rayon, polyester, styrene, styrofoam, orlon, saran, polyurethane, polyethylene, polypropylene, vinyl, PVC, silicon, Teflon and combinations thereof.

17. The system of claim 1 wherein the first charging surface is selected from the group comprising steel, nickel, copper, brass, silver, gold, platinum and combinations thereof.

18. The system of claim 16 wherein the container comprises a generally non-conducting material.

19. The system of claim 18 wherein the container comprises a cardboard.

20. A system for inducing an electric charge in a cleaning sheet for cleaning and removing particles from a surface comprising:

a container having an interior receptacle configured for housing a plurality of cleaning sheets;

an outlet for dispensing at least one of the plurality of cleaning sheets, wherein the outlet includes a first charging surface and a second charging surface;

wherein the first and second charging surfaces are each configured to frictionally engage at least one of the plurality of the cleaning sheets as the cleaning sheet is dispensed through the outlet, thereby inducing an electrostatic charge in the cleaning sheet.

21. The system of claim 20 wherein the first charging surface is generally coplanar with the second charging surface.

22. The system of claim 21 wherein the first charging surface includes a sheet of material generally parallel to a base of the container and the second charging surface includes a sheet of material generally parallel to the base of the container.

23. The system of claim 22 wherein the first charging surface further comprises a sheet of material generally perpendicular to the base of the container and the second charging surface includes a sheet of material generally perpendicular to the base of the container.

24. The system of claim 22 wherein at least one of the first and second charging surfaces are configured to induce a negative charge on the cleaning sheet.

25. A method of inducing an electric charge in a cleaning sheet for cleaning and removing particles from a surface comprising:

dispensing the cleaning sheet from a generally nonconductive container comprising a first charging surface such that frictionally engaging the cleaning sheet against the first charging surface induces an electrostatic charge of at least about 1000 V in the sheet;

wherein the cleaning sheet has a basis weight of at least about 30 g/m$^2$.

26. The method of claim 25 wherein the charge on the sheet is retained for at least about 5 minutes at a humidity of no more than 10% relative humidity.

27. The method of claim 25 wherein the generally nonconductive container further comprises a second charging surface.

28. The method of claim 25 comprising engaging the cleaning sheet against the first charging surface and the second charging surface.

29. The method of claim 28 comprising sequentially engaging the cleaning sheet against the first and second charging surfaces.

30. The method of claim 28 comprising simultaneously engaging the cleaning sheet against the first and second charging surfaces.

31. A method of cleaning a surface comprising:

dispensing a cleaning sheet from a generally nonconductive container comprising at least one charging surface such that frictionally engaging the cleaning sheet against the first charging surface increases an electrostatic charge of the cleaning sheet by at least about 500 V; and contacting the surface with the cleaning sheet;

wherein the cleaning sheet has a basis weight of at least about 30 g/m$^2$.

32. A kit for cleaning surfaces and collecting and retaining debris comprising:

a cleaning head;

a cleaning sheet adapted for coupling to the head; and a container for housing and dispensing the cleaning sheet and having at least one charging surface configured to frictionally engage the cleaning sheet as the cleaning sheet is dispensed from the container;

wherein the charging surface is configured to induce a charge of at least about 1000 V in the cleaning sheet when the cleaning sheet is dispensed from the container.

* * * * *